US010518561B2

(12) United States Patent
Martin et al.

(10) Patent No.: US 10,518,561 B2
(45) Date of Patent: Dec. 31, 2019

(54) PLATEN HOLDER

(71) Applicant: HEWLETT-PACKARD DEVELOPMENT COMPANY, L.P., Houston, TX (US)

(72) Inventors: Pau Martin, Sant Cugat del Valles (ES); Ricardo Sanchis, San Cugat del Valles (ES); Alberto Arredondo, Sant Cugat del Valles (ES); Eduardo Martin, Sabadell (ES); Alejandro Puente, Sant Cugat del Valles (ES)

(73) Assignee: Hewlett-Packard Development Company, L.P., Spring, TX (US)

( * ) Notice: Subject to any disclaimer, the term of this patent is extended or adjusted under 35 U.S.C. 154(b) by 0 days.

(21) Appl. No.: 15/522,347

(22) PCT Filed: Nov. 11, 2014

(86) PCT No.: PCT/US2014/064935
§ 371 (c)(1),
(2) Date: Apr. 27, 2017

(87) PCT Pub. No.: WO2016/076833
PCT Pub. Date: May 19, 2016

(65) Prior Publication Data

US 2017/0320338 A1 Nov. 9, 2017

(51) Int. Cl.
*B41J 2/01* (2006.01)
*B41J 11/06* (2006.01)

(52) U.S. Cl.
CPC ..... *B41J 11/06* (2013.01)

(58) Field of Classification Search
None
See application file for complete search history.

(56) References Cited

U.S. PATENT DOCUMENTS

| | | | | |
|---|---|---|---|---|
| 2,045,020 | A * | 6/1936 | Marchev | B41L 11/00 101/132.5 |
| 3,388,660 | A | 6/1968 | Wight | |
| 4,227,819 | A | 10/1980 | Manriquez | |
| 4,422,782 | A | 12/1983 | Lawler et al. | |
| 4,632,577 | A | 12/1986 | Brull et al. | |
| 4,772,146 | A | 9/1988 | Saito et al. | |
| 4,903,598 | A | 2/1990 | Kobayashi et al. | |
| 5,026,180 | A | 6/1991 | Tajima et al. | |
| 5,156,477 | A | 10/1992 | Hasegawa | |

(Continued)

FOREIGN PATENT DOCUMENTS

| | | |
|---|---|---|
| CN | 1118310 | 3/1996 |
| CN | 2710899 | 7/2005 |

(Continued)

*Primary Examiner* — Matthew Luu
*Assistant Examiner* — Tracey M McMillion
(74) *Attorney, Agent, or Firm* — HP Inc. Patent Department

(57) ABSTRACT

In one example, a platen holder includes a surface to support a platen and a clamp to clamp the platen to the surface. The clamp includes a jaw and an actuator to open and close the jaw. The jaw and the actuator located below a plane of the surface and the jaw movable at the urging of the actuator between an open position in which the platen may be placed on or removed from the surface of the holder and a closed position to hold the platen against the surface.

10 Claims, 22 Drawing Sheets

(56) References Cited

U.S. PATENT DOCUMENTS

| | | | | |
|---|---|---|---|---|
| 5,168,287 | A * | 12/1992 | Okunomiya | B41J 13/223 101/409 |
| 5,362,043 | A | 11/1994 | Grellman | |
| 5,618,117 | A | 4/1997 | Yoshida et al. | |
| 6,106,114 | A * | 8/2000 | Sugiyama | B41J 13/103 347/104 |
| 6,893,173 | B2 * | 5/2005 | McNally | B41J 11/08 400/101 |
| 7,262,878 | B2 * | 8/2007 | Wolber | H04N 1/00002 347/264 |
| 7,399,130 | B2 | 7/2008 | Hirte et al. | |
| 7,641,408 | B2 | 1/2010 | Niikura et al. | |
| 2004/0096257 | A1 | 5/2004 | McNally et al. | |
| 2012/0327160 | A1 * | 12/2012 | Yamamoto | B41J 11/0085 347/44 |
| 2014/0165865 | A1 | 6/2014 | Lopez et al. | |

FOREIGN PATENT DOCUMENTS

| | | | |
|---|---|---|---|
| CN | 1727193 | | 2/2006 |
| JP | 06320814 | A | 11/1994 |
| JP | 2002301842 | | 10/2015 |

* cited by examiner

PLATEN HOLDER

BACKGROUND

In many inkjet printers, the paper or other print substrate is supported on a platen as the substrate moves through the print zone. The platen helps keep the print substrate flat and at the desired distance from the printheads as ink is dispensed on to the substrate.

DRAWINGS

FIG. 1 is viewed along the line 1-1 in FIG. 2.

The same part numbers designate the same or similar parts throughout the figures.

DESCRIPTION

In some inkjet printers, a substrate wide printhead assembly that remains stationary during printing, commonly called a print bar, is used to print on a substrate moving past the print bar. A platen supports the substrate as it moves through the print zone under the print bar. To help keep the substrate flat and at the desired distance from the print bar, the platen itself must be flat throughout the full expanse of the print zone. The wider platens used in large format inkjet printers require more robust mounting systems to help keep the platen flat. Usually the platen is screwed down to the printer chassis to hold it flat. In some printers, the platen is a "service part" that may be replaced if worn or damaged. A substrate wide print bar covers the top of the platen and, therefore, blocks access to platen mounting screws.

A new platen holder has been developed for use with replaceable platens in printers that have a substrate wide print bar. The examples of the new holder shown in the figures and described below allow the platen to be installed, removed and replaced without accessing the top of platen while still providing robust mounting to help keep the platen flat. In one example, the platen holder includes multiple datum surfaces and a clamp to clamp the platen to the datum surfaces. Both the jaws of the clamp and the actuator for the jaws are located below the plane of the datum surfaces. The jaws are movable at the urging of the actuator between an open position in which the platen may be moved in and out under the print bar and a closed position to clamp the platen securely on the datum surfaces.

Examples of the new platen holder are not limited to use with print bars or in inkjet printers, but may be implemented in other devices and for uses other than printing. Accordingly, the examples shown in the figures and described herein illustrate but do not limit the subject matter claimed below.

As used in this document, a "datum" means something used as a basis for positioning, measuring or calculating; a "jaw" means a part of a clamp that contacts an object to be clamped; a "printhead" means that part of an inkjet printer or other inkjet type dispenser that dispenses fluid from one or more openings, for example as drops or streams; and a "print bar" means a structure or device holding an arrangement of one or more printheads that remains stationary during printing. "Printhead" and "print bar" are not limited to printing with ink but also include inkjet type dispensing of other fluids and/or for uses other than printing.

Figure 1:
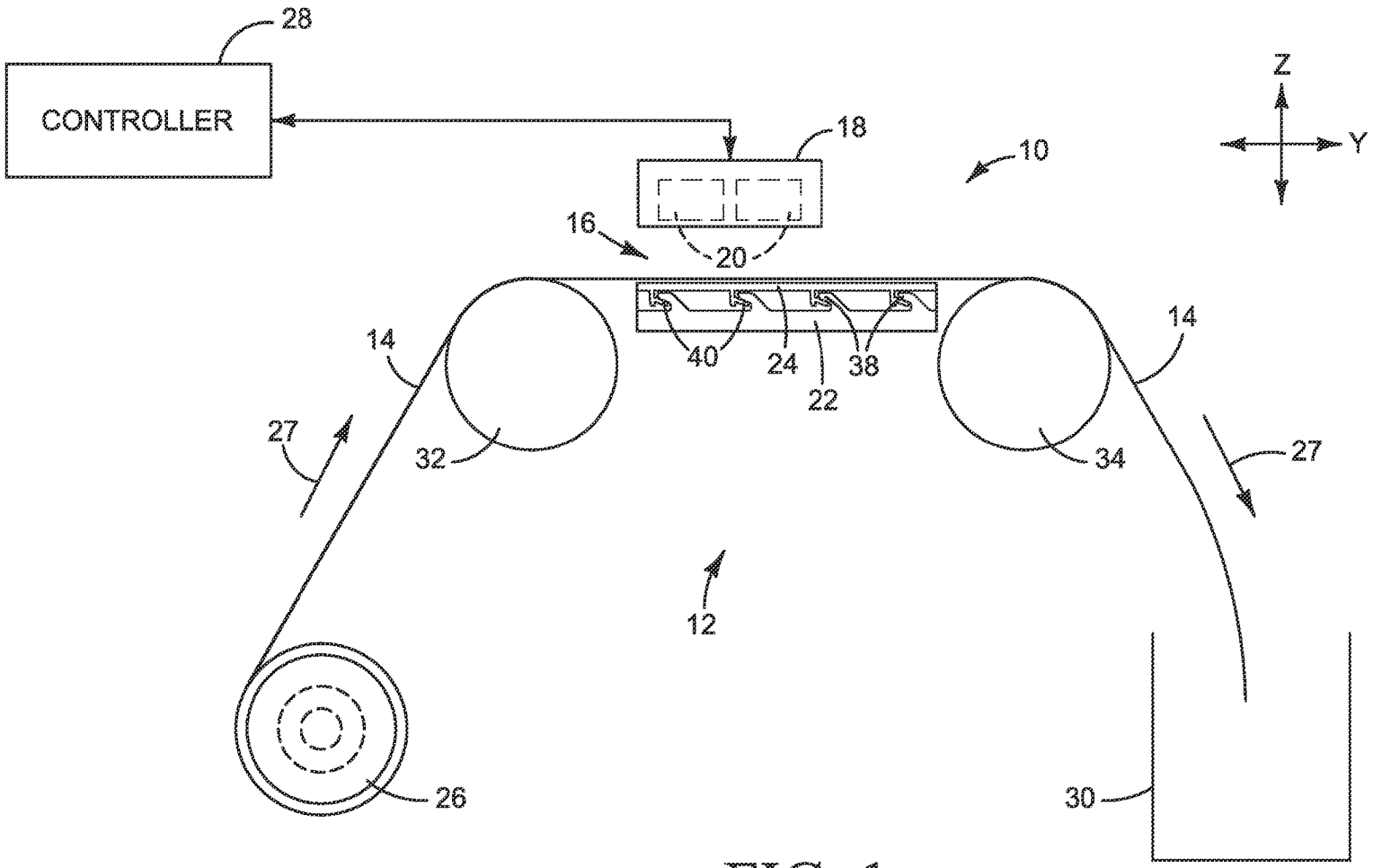
FIGS. 1 and 2 are elevation and plan views, respectively, illustrating an inkjet printer implementing one example of a platen assembly.
Figure 2:
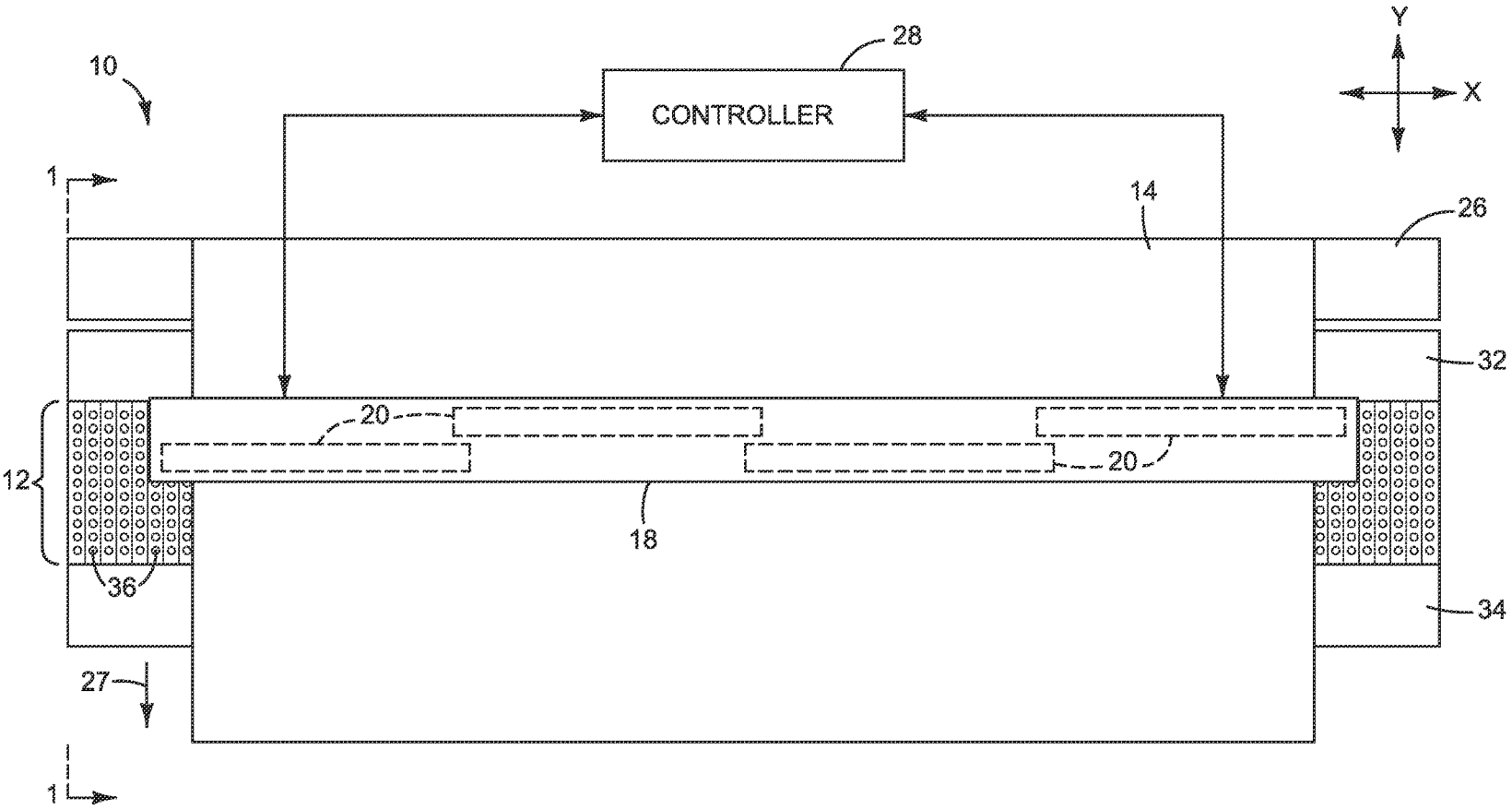

FIGS. 1 and 2 illustrate an inkjet printer 10 implementing one example of a platen assembly 12 for supporting a print substrate 14 through a print zone 16. Referring to FIGS. 1 and 2, printer 10 includes a printhead assembly 18 with multiple printheads 20 mounted over platen assembly 12. In the example shown, printhead assembly 18 is configured as a substrate wide print bar that remains stationary during printing. As shown in the elevation view of FIG. 1, platen assembly 12 includes a chassis 22 and a platen 24 mounted to chassis 22. Platen chassis 22 is mounted to or integral with the printer chassis (not shown) or otherwise supported in the printer.

During printing, a print substrate web 14 from a supply roll 26 is moved across platen 24 into print zone 16 under print bar 18. The movement of web 14 is indicated by direction arrows 27 in FIGS. 1 and 2. Printheads 20 dispense ink or other printing fluid on to substrate 14 at the direction of a controller 28 as substrate 14 passes through print zone 16. Controller 28 represents generally the electronic instructions, processors and associated memories, and the electronic circuitry and components needed to control printheads 20 and the other operative elements of printer 10. Printed sheets may be cut from web 14 and collected in a bin 30. Intermediate rollers 32, 34 may be used to help transport substrate 14 through print zone 16.

Other configurations for printer 10 are possible. For example, substrate 14 may be collected on a take-up roll rather than cut into a bin, or sheets of print substrate used instead of a web. For another example, the printheads may be carried on a scanning printhead assembly rather than mounted to a stationary print bar as shown in FIGS. 1 and 2.

Platen 24 may include vacuum holes 36, shown in FIG. 2, connected to a vacuum source (not shown) to draw substrate 14 down against platen 24 to help keep substrate 14 flat during printing. Substrate 14 may be supported directly on platen 24, as shown, or indirectly through a belt or other intermediary. In the example of platen assembly 12 shown in FIGS. 1 and 2, platen 24 is mounted to chassis 22 with hooks 38 on chassis 22 and mating hooks 40 on platen 24. Chassis hooks 38 face one direction and platen hooks 40 face the opposite direction. As described in detail below, one or both groups of hooks 38, 40 are movable between an engaged position (shown in FIG. 1) in which hooks 38 and 40 are engaged to clamp platen 24 to chassis 22, and a disengaged position in which hooks 38 and 40 are not engaged and platen 24 may be removed from or placed on chassis 22.

Figure 3:
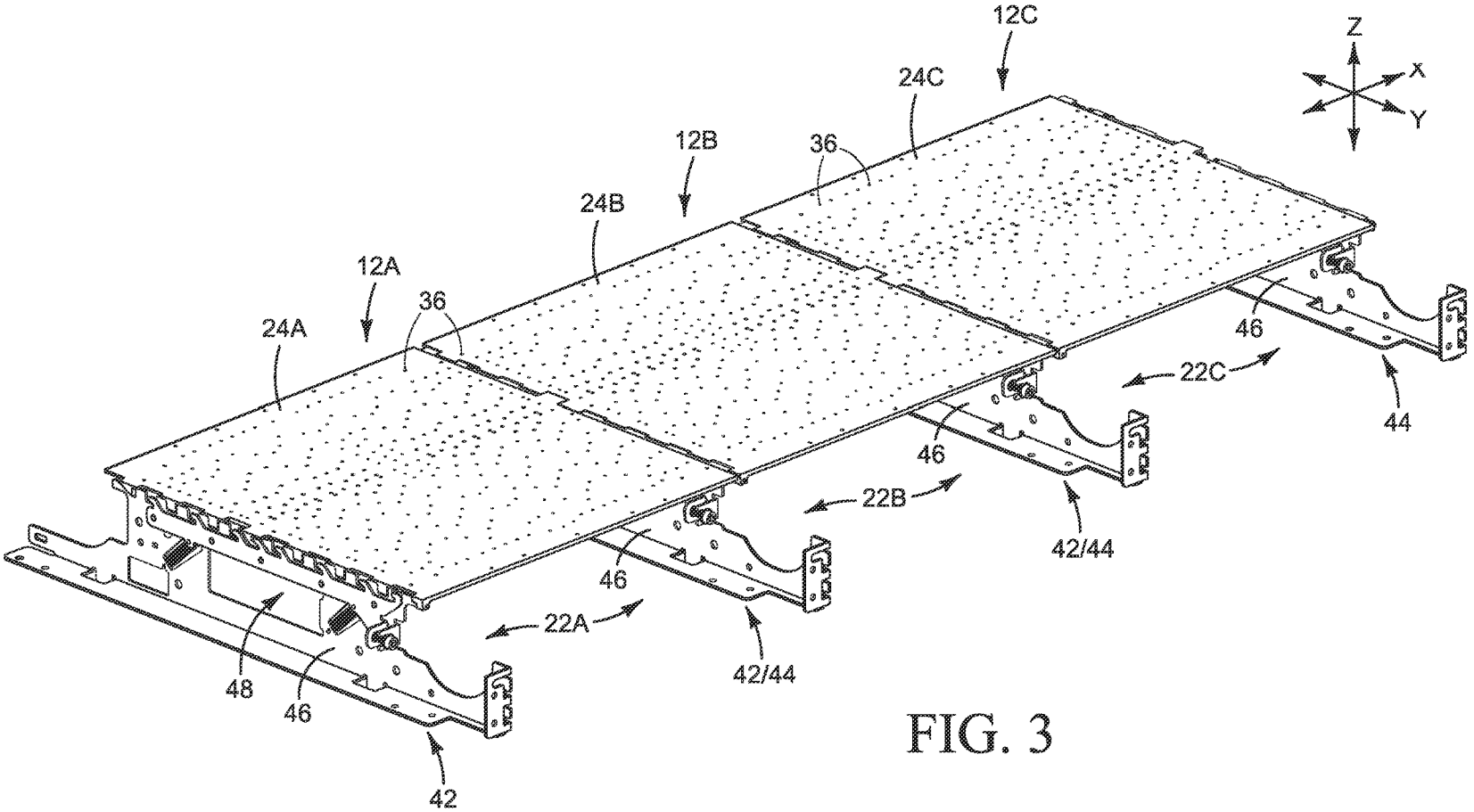
FIGS. 3 and 4 are perspective and elevation views, respectively, illustrating one example of a platen assembly such as might be used in the printer shown in FIGS. 1 and 2.
Figure 4:
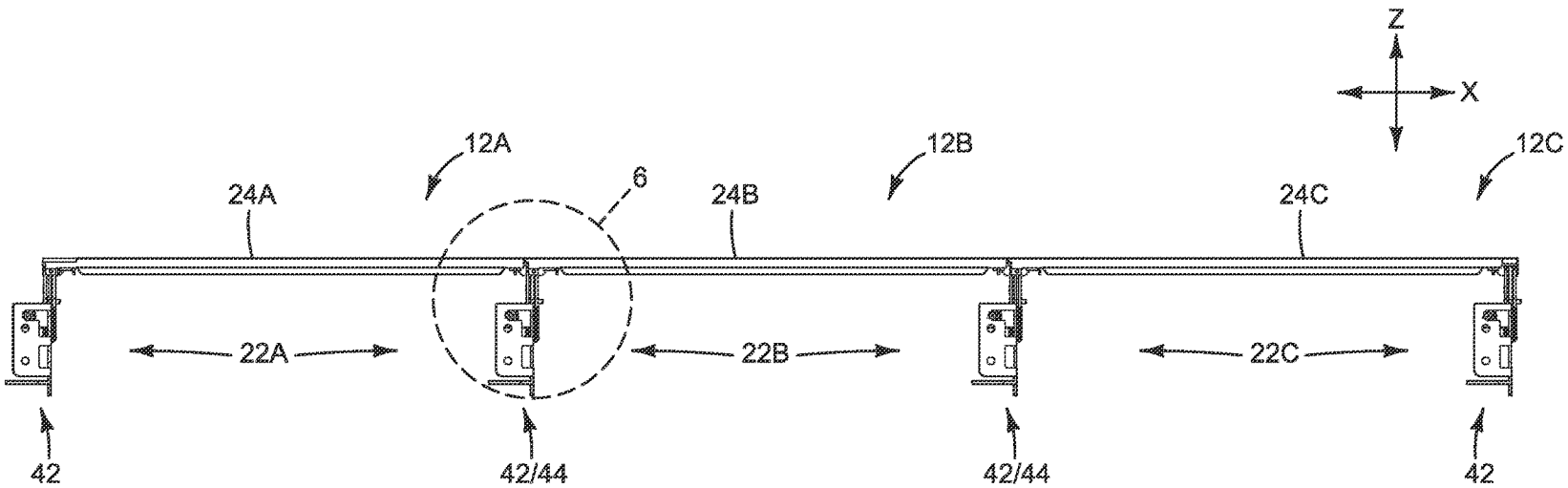
Figure 5:
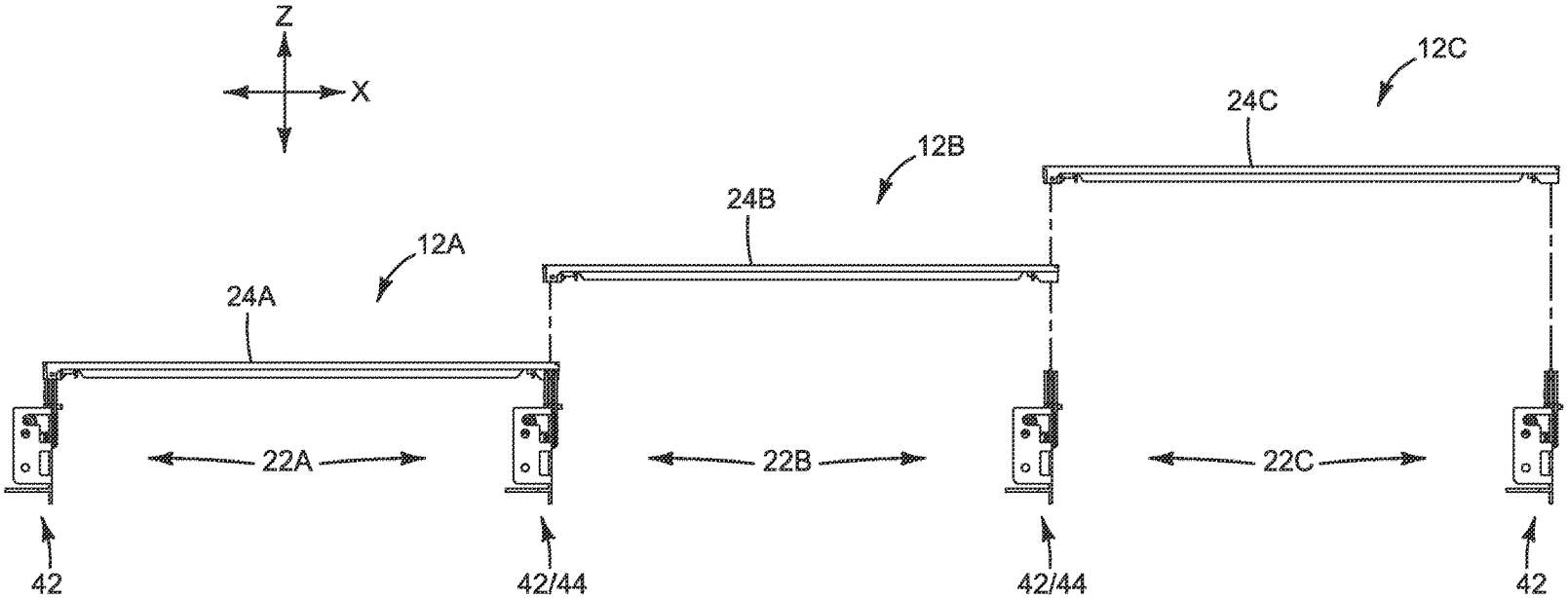
FIG. 5 is a partially exploded view of the platen assembly shown in FIGS. 3 and 4.
Figure 6:
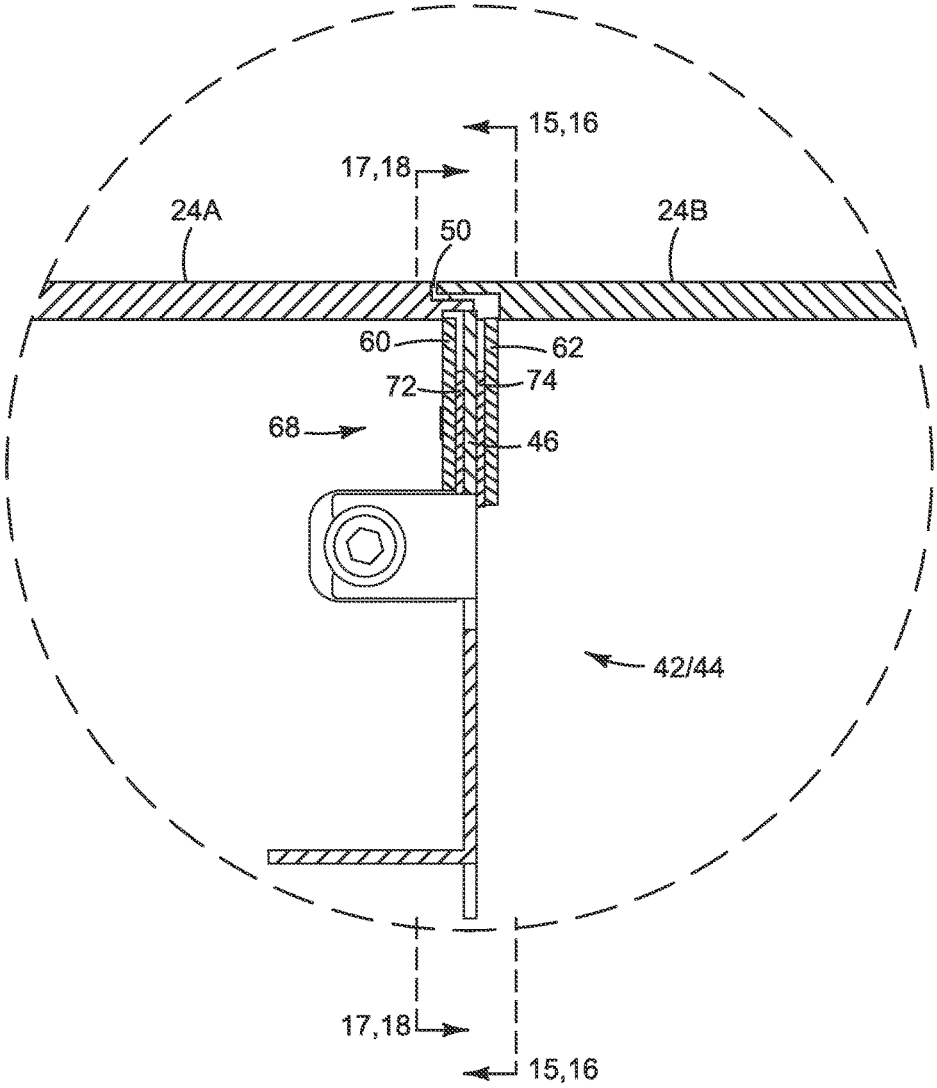
FIG. 6 is a detail from FIG. 4.

FIGS. 3 and 4 are perspective and elevation views illustrating one example of a platen assembly 12 such as might be used in printer 10 shown in FIGS. 1 and 2. FIG. 5 is a partially exploded view of the platen assembly 12 from FIGS. 3 and 4 and FIG. 6 is a detail from FIG. 4. Referring to FIGS. 3-6, platen assembly 12 includes three subassemblies 12A, 12B and 12C to span the width of the print zone. More or fewer subassemblies are possible. While a single zone-wide assembly could be used, multiple subassemblies may be desirable in many printing applications to increase versatility and more easily accommodate print zones of different widths.

Each subassembly 12A, 12B, 12C includes a chassis 22A, 22B, 22C and a platen 24A, 24B, 24C mounted to the respective chassis. Each chassis 22A, 22B, 22C includes a first part 42 along one side of the respective platen and a second part 44 along the opposite side of the platen. In the example shown, each platen subassembly 12A, 12B, 120 shares a chassis part 42, 44 with an adjoining subassembly. Therefore, the second chassis part 44 for subassembly 22A is the first chassis part 42 for subassembly 228, and so on for the other adjoining subassemblies. Each chassis part 42, 44 includes a base 46 and a clamp 48. As best seen in FIGS. 5 and 6, the platens are assembled to a respective chassis sequentially with each successive platen overlapping the respective preceding platen at a joint 50 to help maintain uniformity across the surface of the platens. In the example shown, platens 24A, 24B and 24C are identical to one another as are chassis parts 42 and 44.

Figure 7:
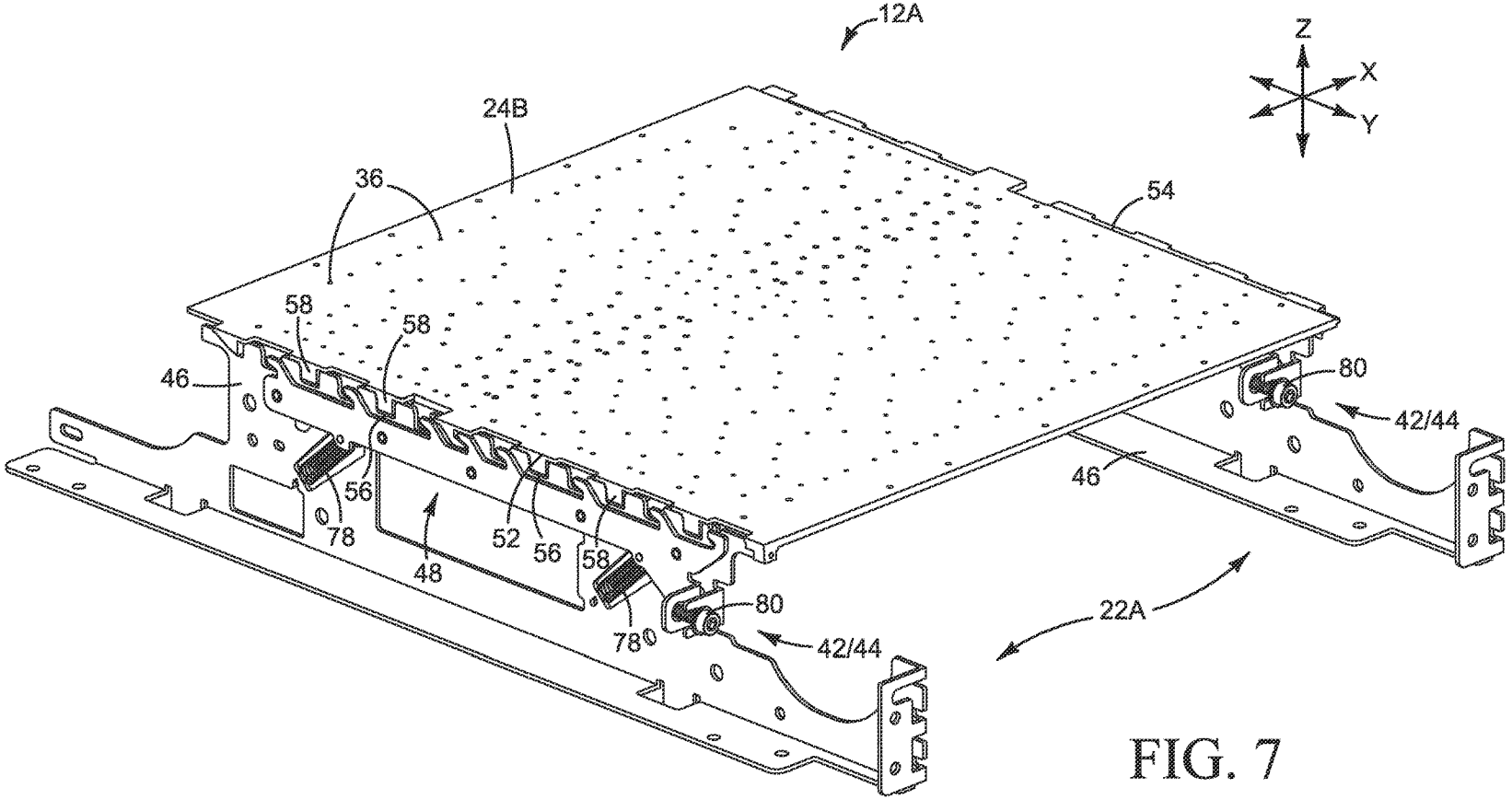
FIG. 7 illustrates one section of the platen assembly shown in FIGS. 3 and 4.
Figure 8:
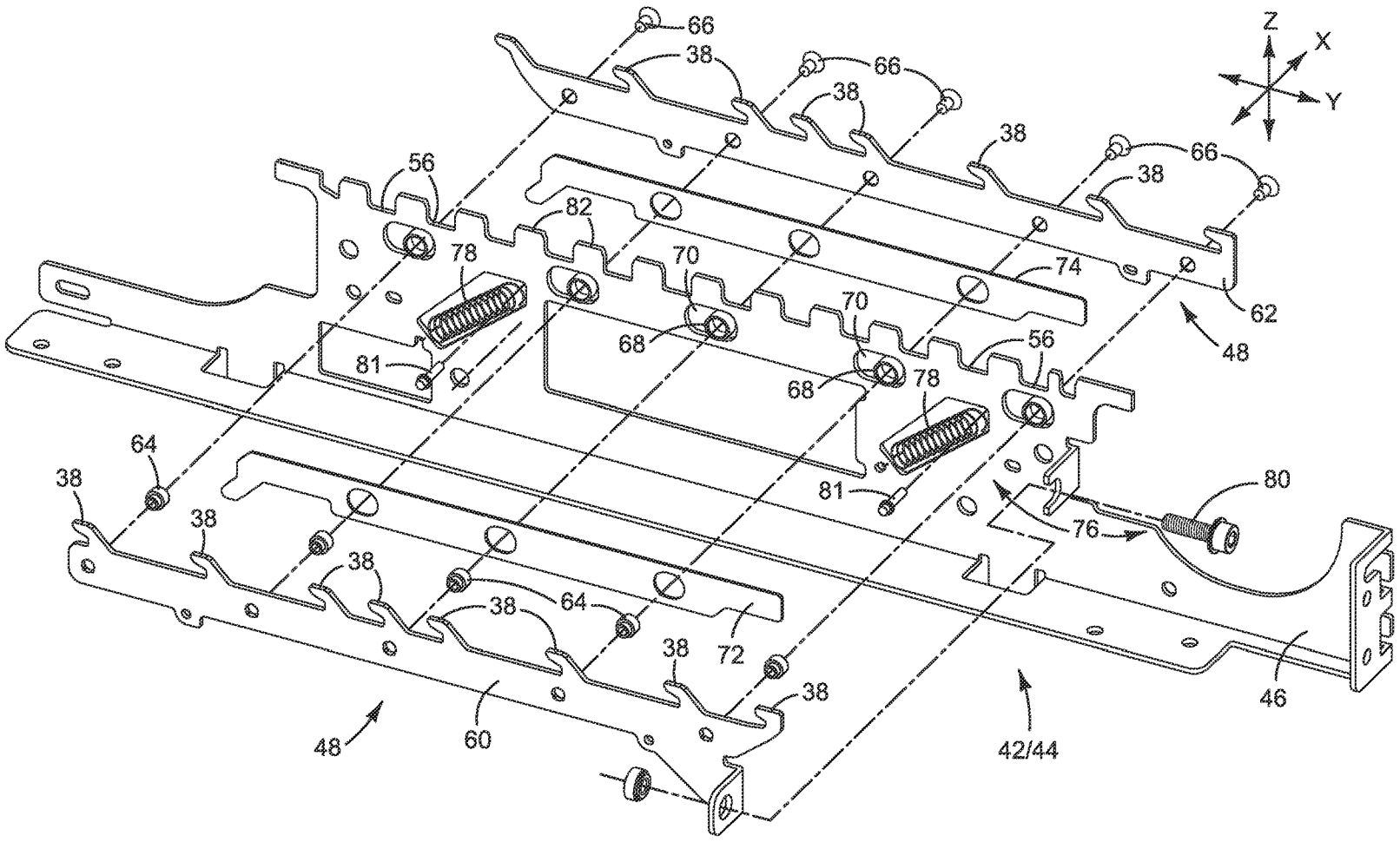
FIGS. 8 and 9 are close-up perspective and elevation views, respectively, showing one of the chassis parts in the assembly shown in FIGS. 3 and 4.
Figure 9:
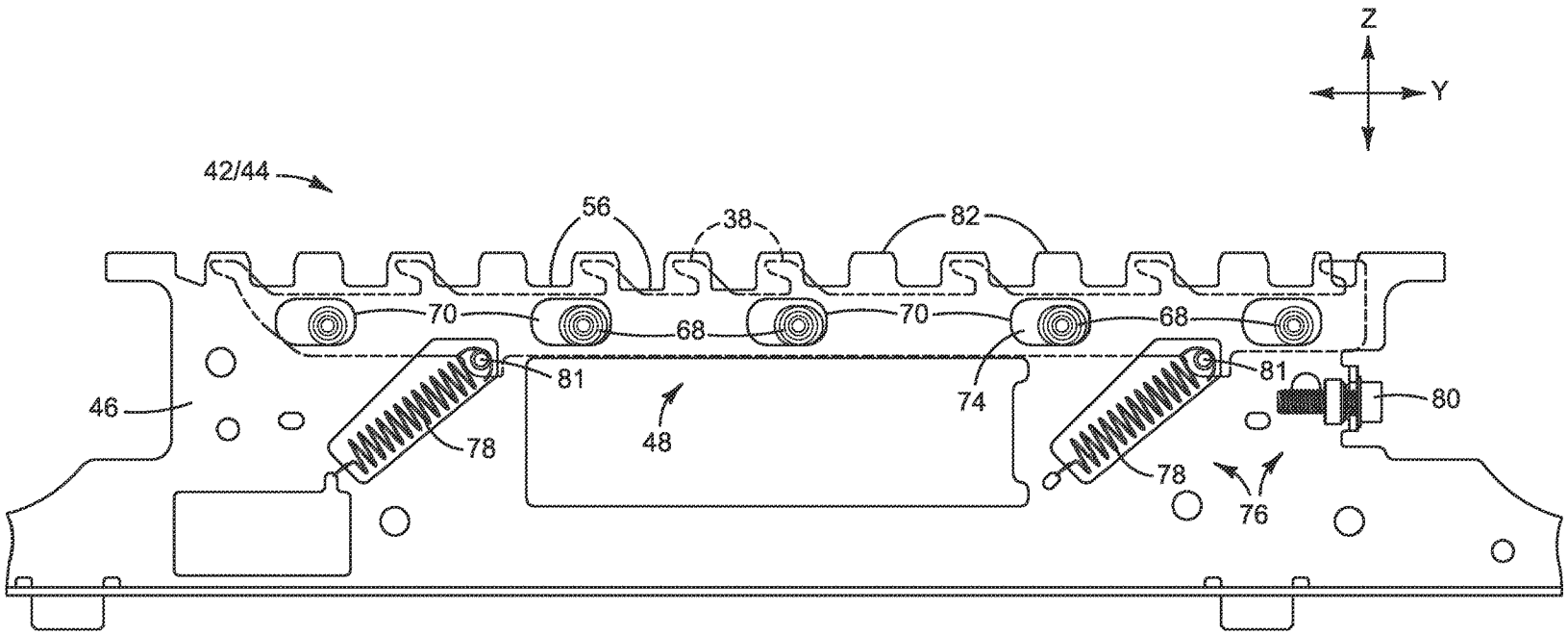

Details of the interconnection between the platens and the chassis parts will now be described with reference to FIGS. 7-18. FIG. 7 is a close-up perspective showing platen subassembly 12A. FIGS. 8 and 9 are close-up perspective and elevation views showing one of the chassis parts 42, 44, FIGS. 10-18 present a sequence of views that illustrate installing platens 24A and 24B on to chassis part 42/44.

Referring first to FIGS. 7-9, platen 24A is mounted to chassis parts 42 and 44 along each side 52, 54 extending in the Y direction. Chassis base 46 includes alignment features 56 that mate with alignment features 58 (FIG. 7) on platen 24A to correctly align platen 24A to base 46. In the example shown, the chassis base alignment features are configured as recesses 56 and the platen alignment features are configured as projecting tabs 58 that fit into recesses 56. Platen 24A is attached to base 46 with clamp 48. As best seen in FIGS. 8 and 9, clamp 48 includes hooks 38 attached to or integral with each of two slide plates 60, 62. Hooks 38 on slide plates 60, 62 form the jaws of clamp 48. As described below with reference to FIGS. 10-18, the hooks 38 on left slide plate 60 hold down the right side 54 of platen 12A and the hooks 38 on the right slide plate 62 hold down the left side 52 of platen 12B.

Slide plates 60, 62 are fastened to chassis base 46 with any suitable fastener that allows plates 60, 62 to slide horizontally (in the Y direction) relative to base 46. For example, as shown in FIGS. 8 and 9, nuts 64 and bolts 66 fasten slide plates 60, 62 to base 46. Bolts 66 are supported on bushings 68 in slots 70 in base 46 to allow bolts 66 and thus slide plates 60, 62 to slide along base 46 in the Y direction. In this example, slots 70 are also slotted in the Z direction to allow plates 60, 62 to slide vertically relative to base 46. Spacers 72, 74 may be used as desired to correctly position slide plates 60, 62 on base 46.

Clamp 48 also includes an actuator 76 to open and close hooks 38 to apply a clamping force to hold the platens in place on the chassis. Actuator 76 is operatively connected between slide plates 60, 62 and base 46. In the example shown, actuator 76 includes springs 78 and lead screw 80. Lead screw 80 is connected between slide plates 60, 62 and base 46 to slide plates 60, 62 along base 46 in slots 70. Springs 78 are stretched between slide plates 60, 62 (on pins 81) and base 46 to pull each slide plate along (the Y direction) base 46 in slots 70. In the example shown, springs 78 are oriented at an acute angle between each plate 60, 62 and base 46 to also pull the plates down (the Z direction) in slots 70. Springs 78 continuously urge the slide plates 60, 62 and thus hooks 38 along and down base 46 for a constant, controlled loading on the platen in the Y and Z directions to help keep the platen clamped in the desired position, and allowing the removal of screw 80.

Figure 10:
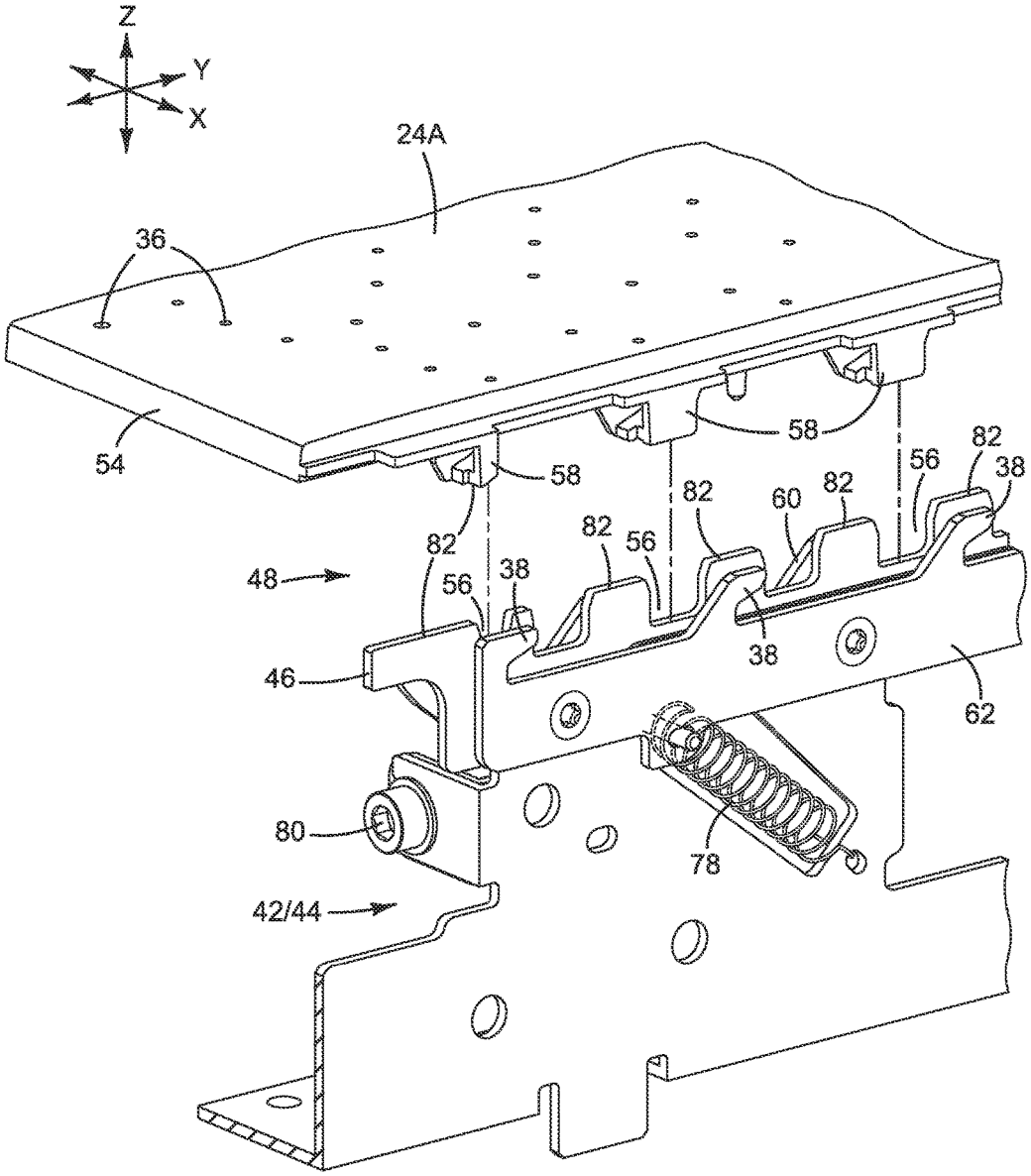
FIGS. 10-14 are a sequence of views that illustrate installing two platens in part of the chassis in the assembly shown in FIGS. 3 and 4.
Figure 11:
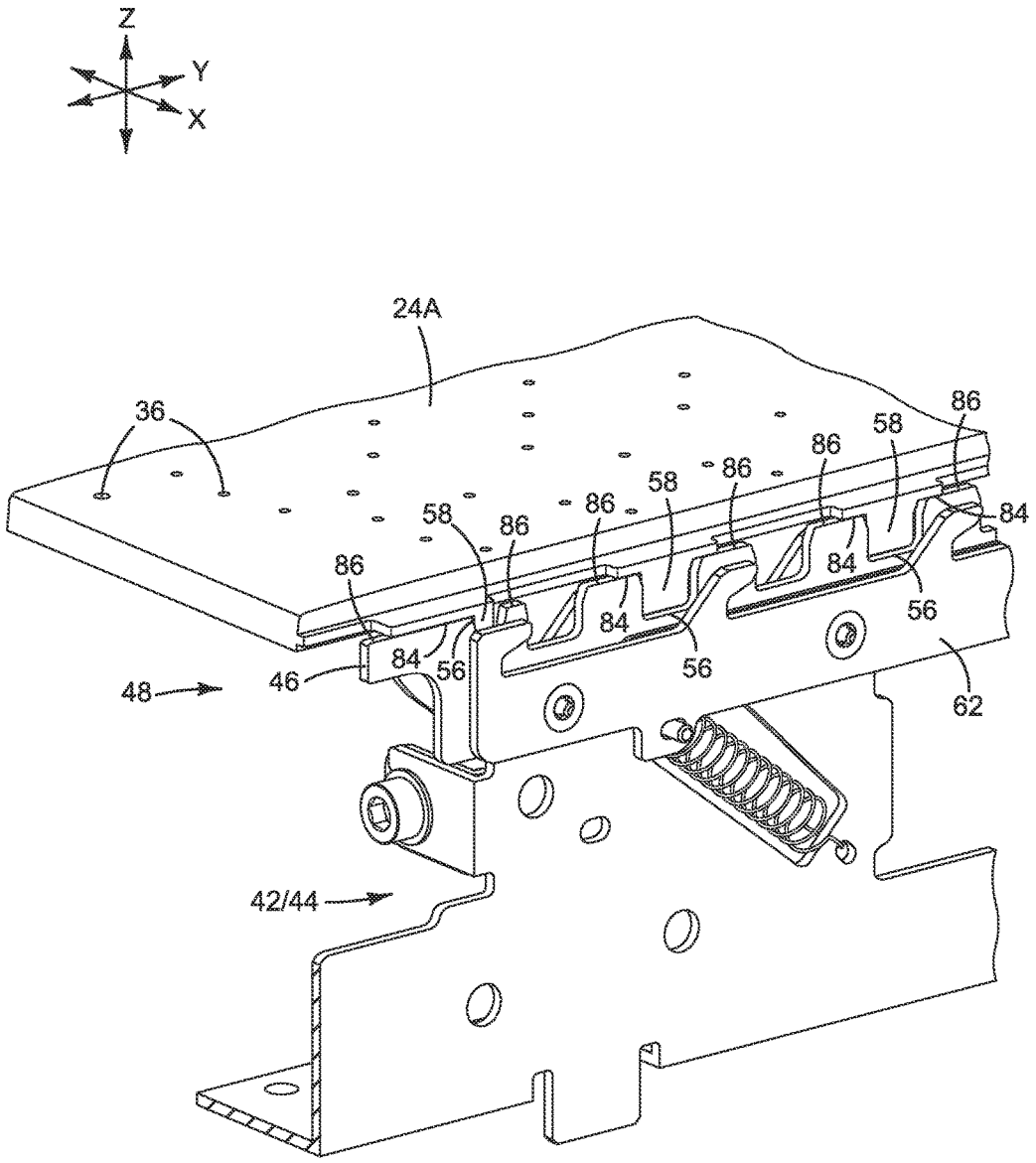
Figure 12:
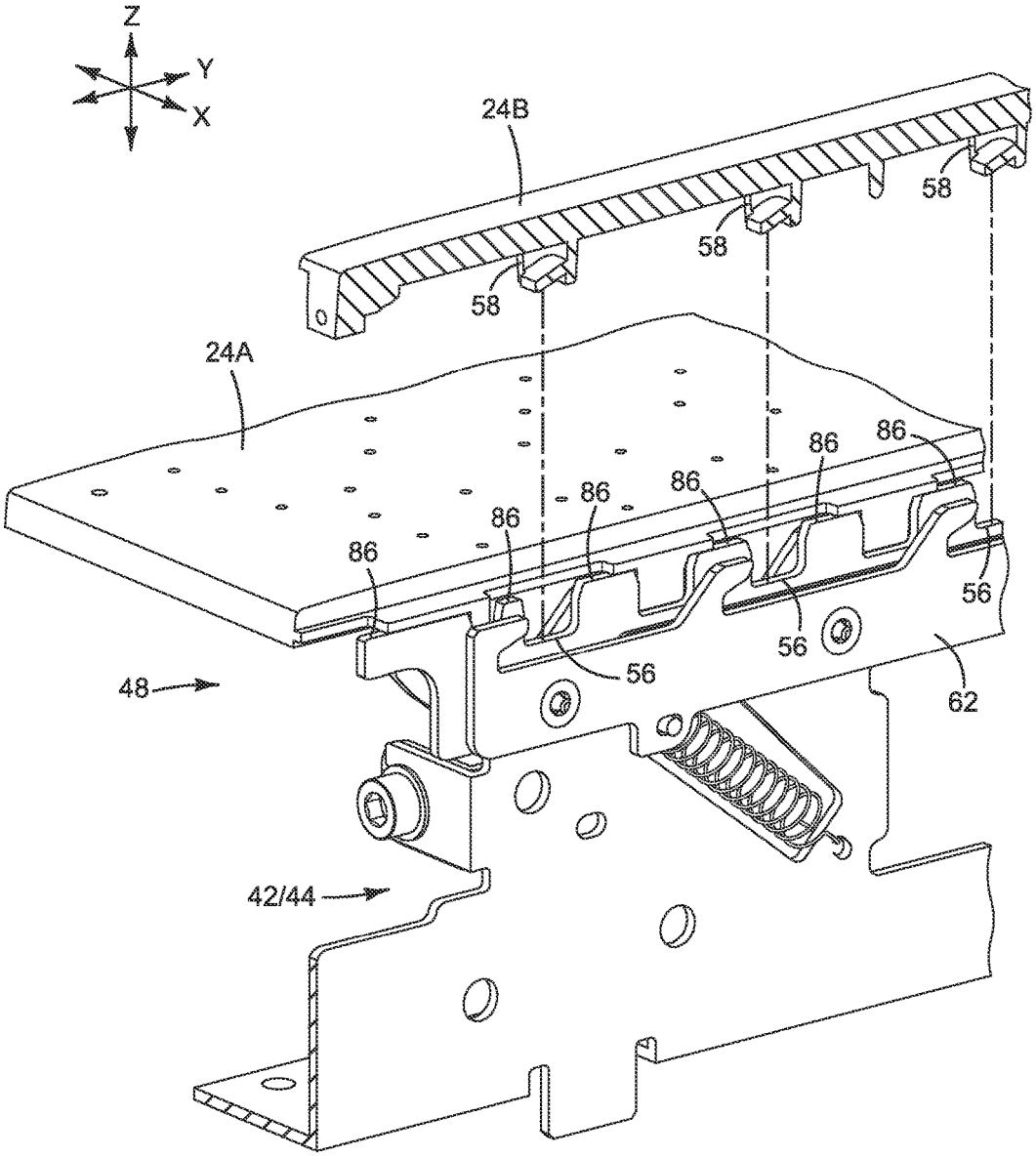
Figure 13:
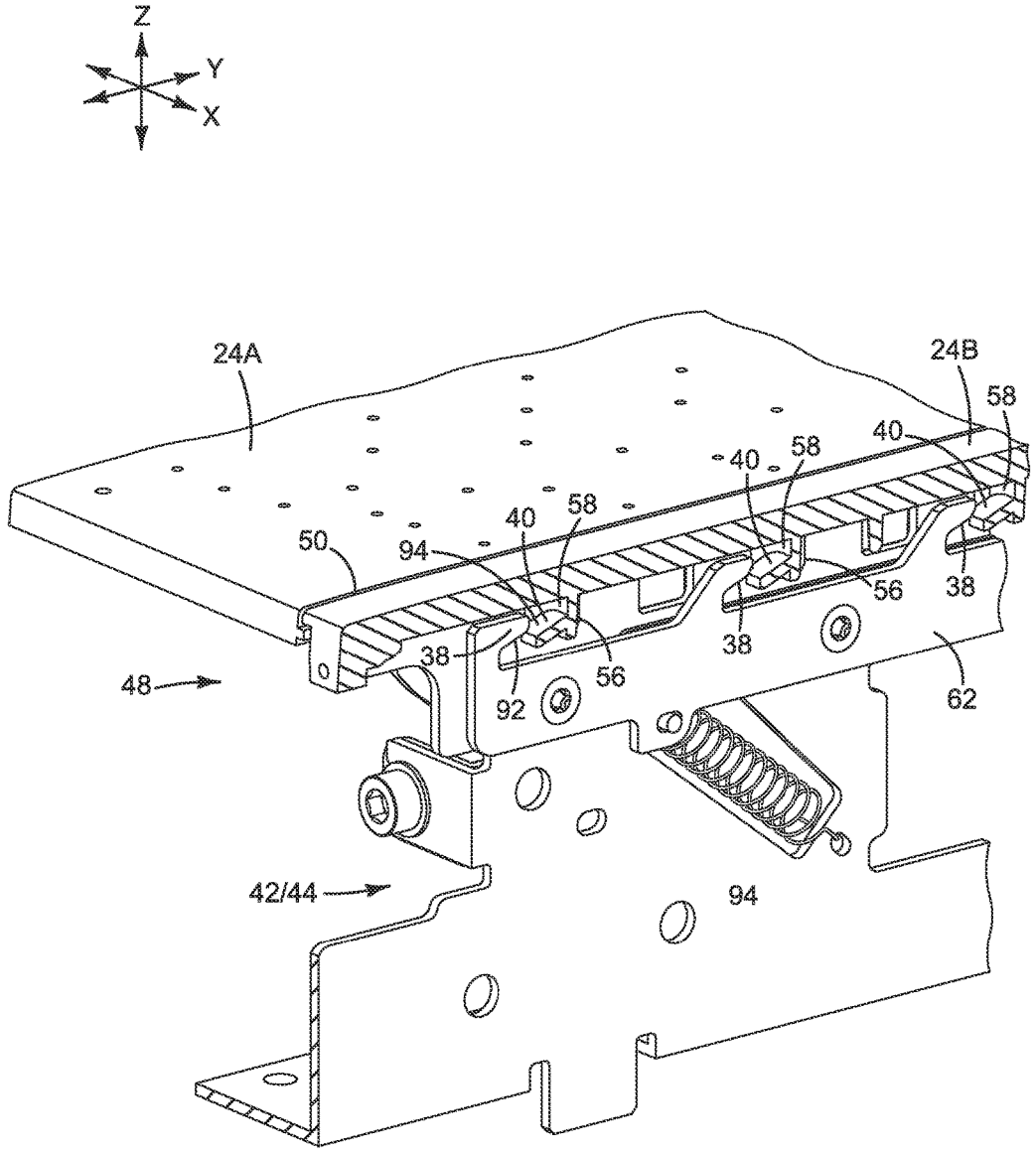

Referring now to the mounting sequence shown in FIGS. 10-18, platen 24A is placed over chassis part 42/44 with tabs 58 aligned to corresponding recesses 56 and clamp 48 open-hooks 38 on slide plates 60, 62 in a disengaged position, as shown in FIG. 10. Platen 24A is lowered into position on base 46, as shown in FIG. 11, with tabs 58 in recesses 56. Platen 24B is then placed over chassis part 42/44, as shown in FIG. 12, and lowered into position on base 46 with tabs 58 in corresponding recesses 56 as shown in FIG. 13. Tabs 58 on the right side 54 of platen 24A and tabs 58 on the left side 52 of platen 24B are arranged in a staggered configuration to align with corresponding alternating recesses 56 on chassis base 46, as best seen by comparing the explosion lines in FIGS. 10 and 12.

Each platen rests on a series of datum surfaces 82 (FIG. 10) along the top of base 46. The right side 54 of platen 24A is visible resting on datum surfaces 82 at locations 84 in FIG. 11. Although not visible in the figures, the left side 52 of platen 24B also rests on datum surfaces 82 at locations 86, which are shown in FIGS. 11 and 12. Tabs 58 may fit loosely in recesses 56 in the Y direction before clamping, as shown in FIG. 11, to facility assembly.

Figure 14:
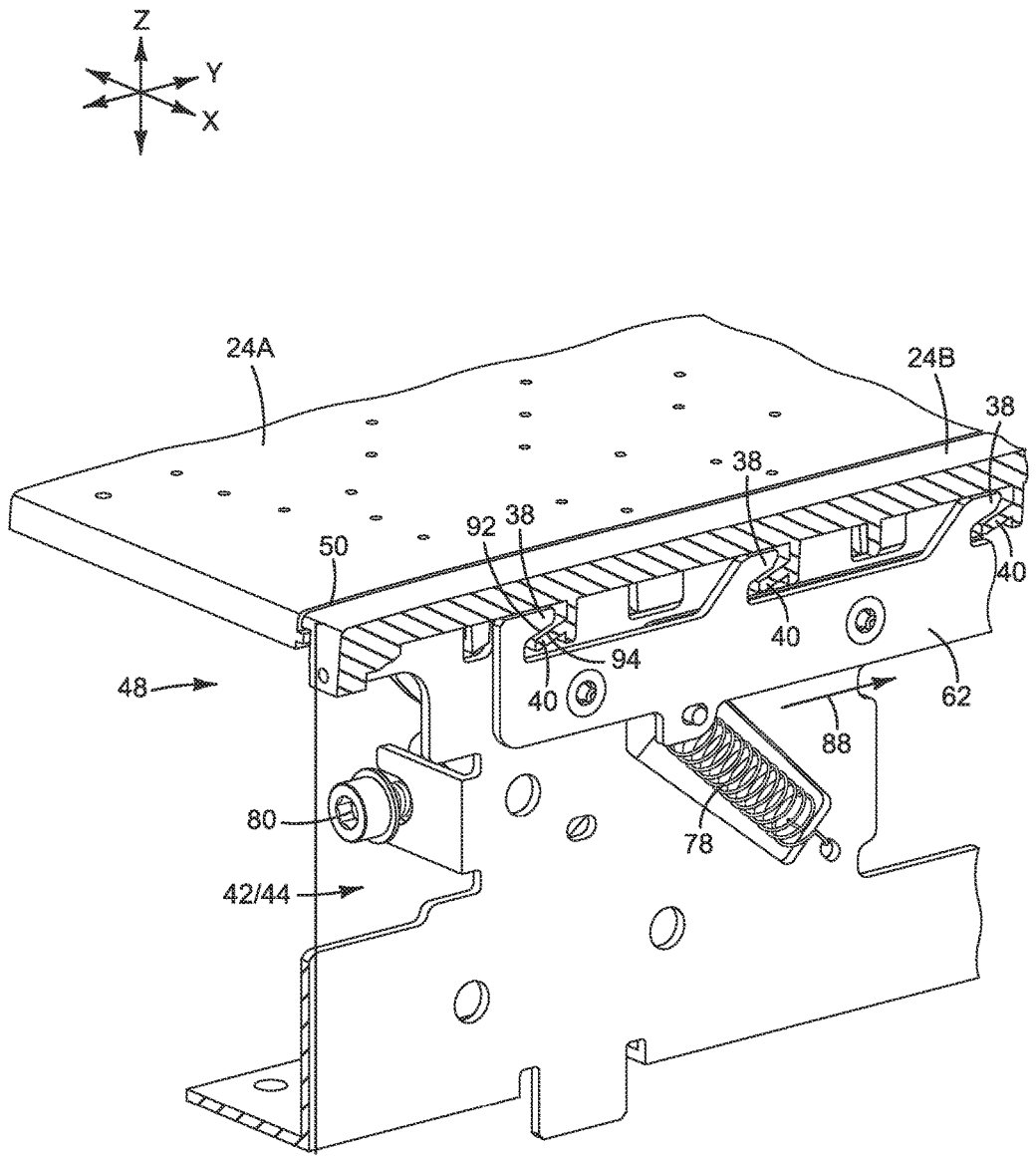

After the overlapping platens 24A and 243 are supported along joint 50 on datum surfaces 82, as shown in FIG. 13, clamp 48 is closed by moving slide plates 60, 62 in the Y direction so that chassis hooks 38 engage platen hooks 40, as shown in FIG. 14. Each platen 24A, 24B is clamped tight against chassis datum surfaces 82 to precisely position the platen in the Z direction, and thus help maintain the desired spacing between the platen and the printheads for good print quality.

Figure 15:
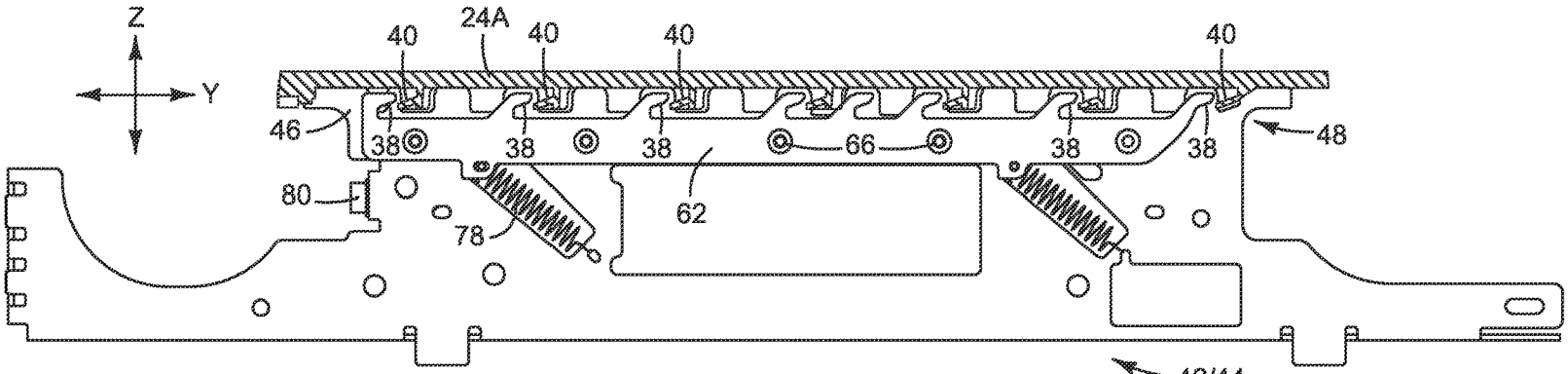
FIGS. 15-18 are side elevation views illustrating clamping the platens to the chassis in the installation sequence shown in FIGS. 10-14.
Figure 16:
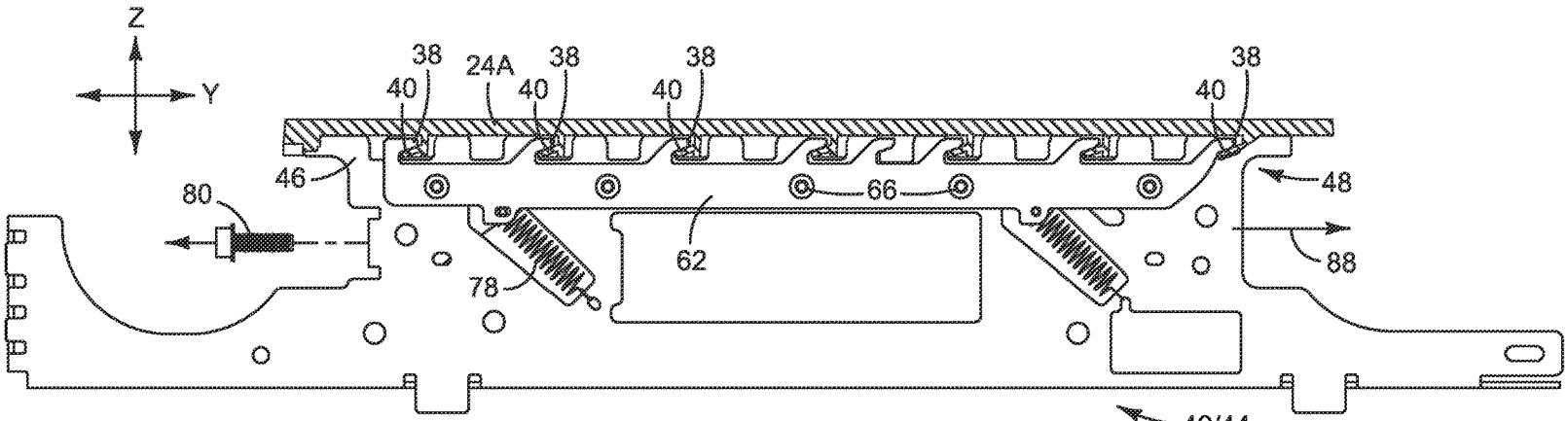
Figure 17:
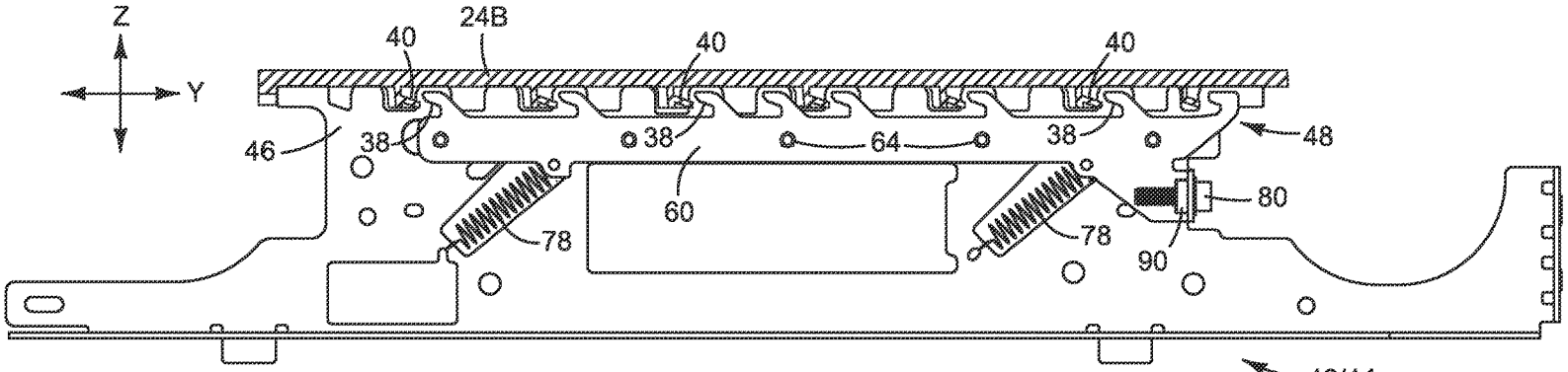
Figure 18:
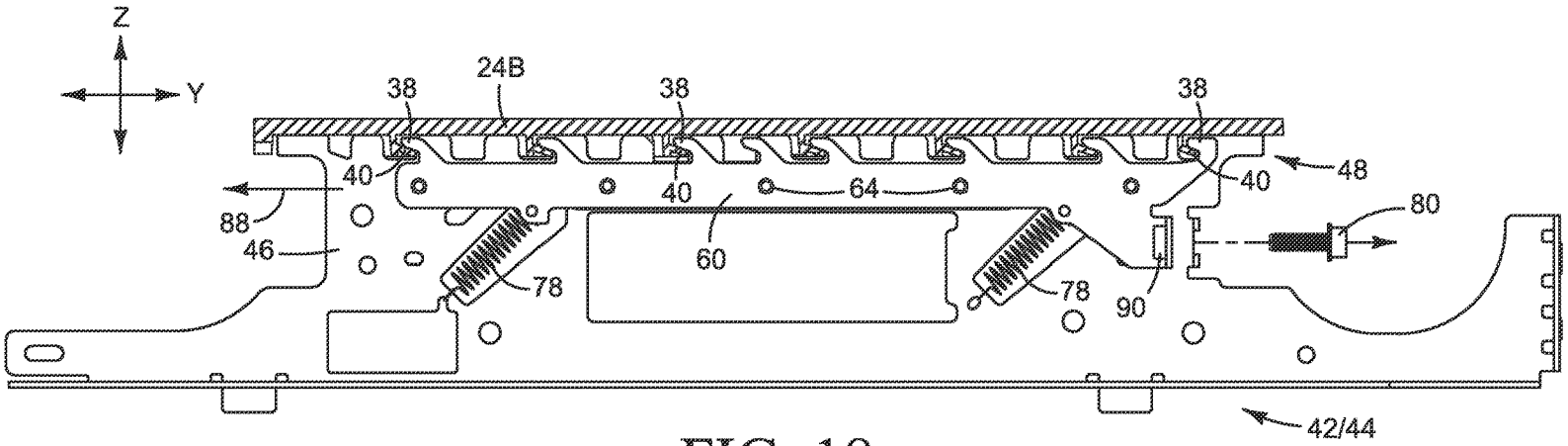

The side elevations of FIGS. 15-18, which show both side plates 60, 62 and all hooks 38, 40, also illustrate closing clamp 48. The elevations of FIGS. 15, 16 and 17, 18 are viewed along the lines 15/16-15/16 and 17/18-17/18 in FIG. 6. The clamping action is best seen by comparing the position of hooks 38 in (1) FIGS. 13 and 14 showing hooks 40 on platen 24B, (2) FIGS. 15 and 16 showing hooks 40 on platen 24A, and (3) FIGS. 17 and 18 also showing hooks 40 on platen 24B. The motion of slide plates 60, 62 to the engaged position is indicated by direction arrows 88 in FIGS. 14, 16 and 18.

Referring to FIGS. 13-18, clamp 48 includes chassis hooks 38, slide plates 60, 62 and actuator 76. Actuator 76, in this example, includes springs 78 and lead screw 80. The movable slide plates 60, 62 are operatively connected to the stationary chassis base 46 through screw 80 and a nut or other threaded receiver 90 on slide plate 60. Springs 78 pull continually on slide plates 60, 62 in the Y and Z directions. With springs 78 pulling on plates 60, 62, screw 80 acts as a lead screw, converting rotation to translation-turning screw 80 clockwise (for a right hand thread) moves slide plates 60, 62 toward the disengaged position shown in FIGS. 13, 15 and 17, and turning screw 80 counterclockwise allows springs 78 to move slide plates 60, 62 toward the engaged position shown in FIGS. 14, 16 and 18.

Each chassis hook 38 includes a ramp 92 (FIGS. 13 and 14). Each platen hook 40 includes a ramp 94 (FIGS. 13 and 14). Each ramp 92 on a hook 38 faces the ramp 94 on a corresponding hook 40. As clamp 48 closes, indicated by arrows 88 in FIGS. 14, 16, and 18, ramps 92 on chassis hooks 38 engage and ride up on ramps 94 on platen hooks 40 to exert a clamping force on the platens down against datum surfaces 82 (the Z direction) and along chassis base 46 (the Y direction). Springs 78 are resilient when stretched as shown to apply a continuous clamping force to hold platens 24A and 24B in the desired position on chassis base 46. Once the ramps are engaged, screw 80 may be removed, if desired, until it is needed to retract the slide plates and open clamp 48.

Figure 19:
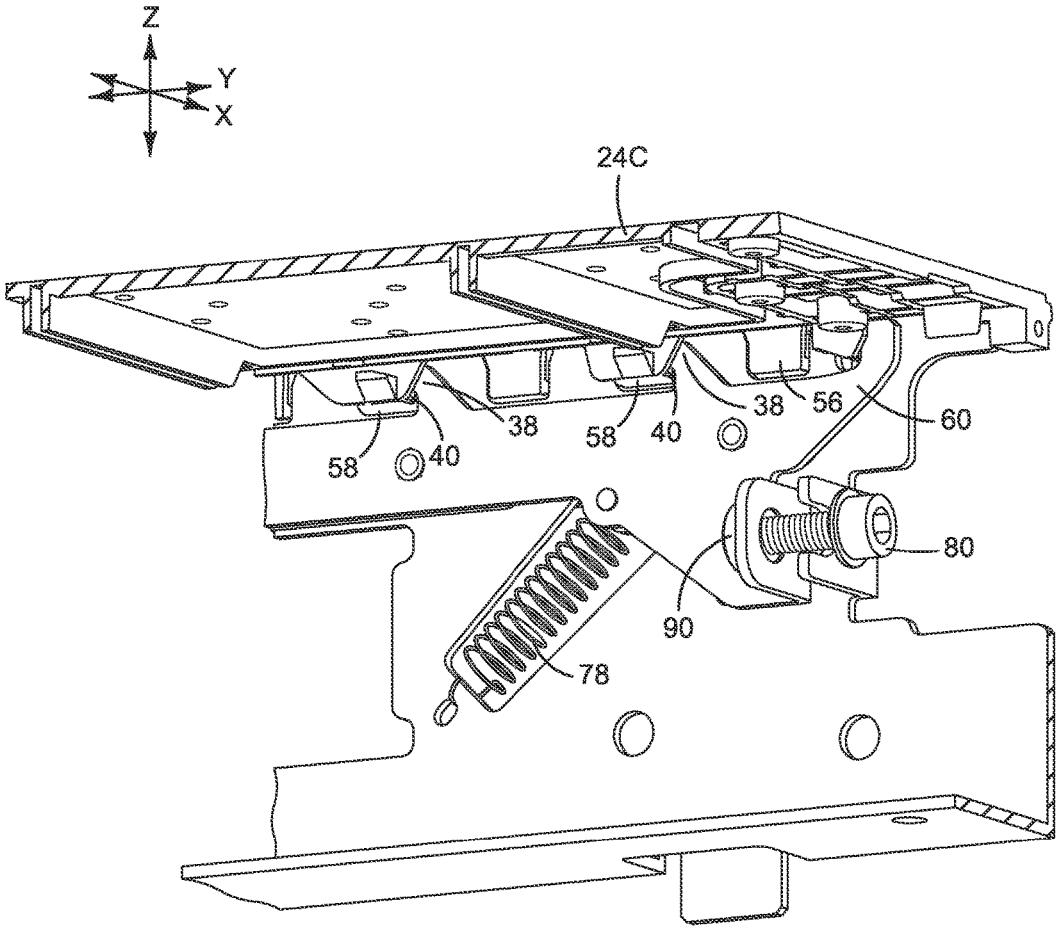
FIGS. 19 and 20 illustrate two platens clamped to the chassis.
Figure 20:
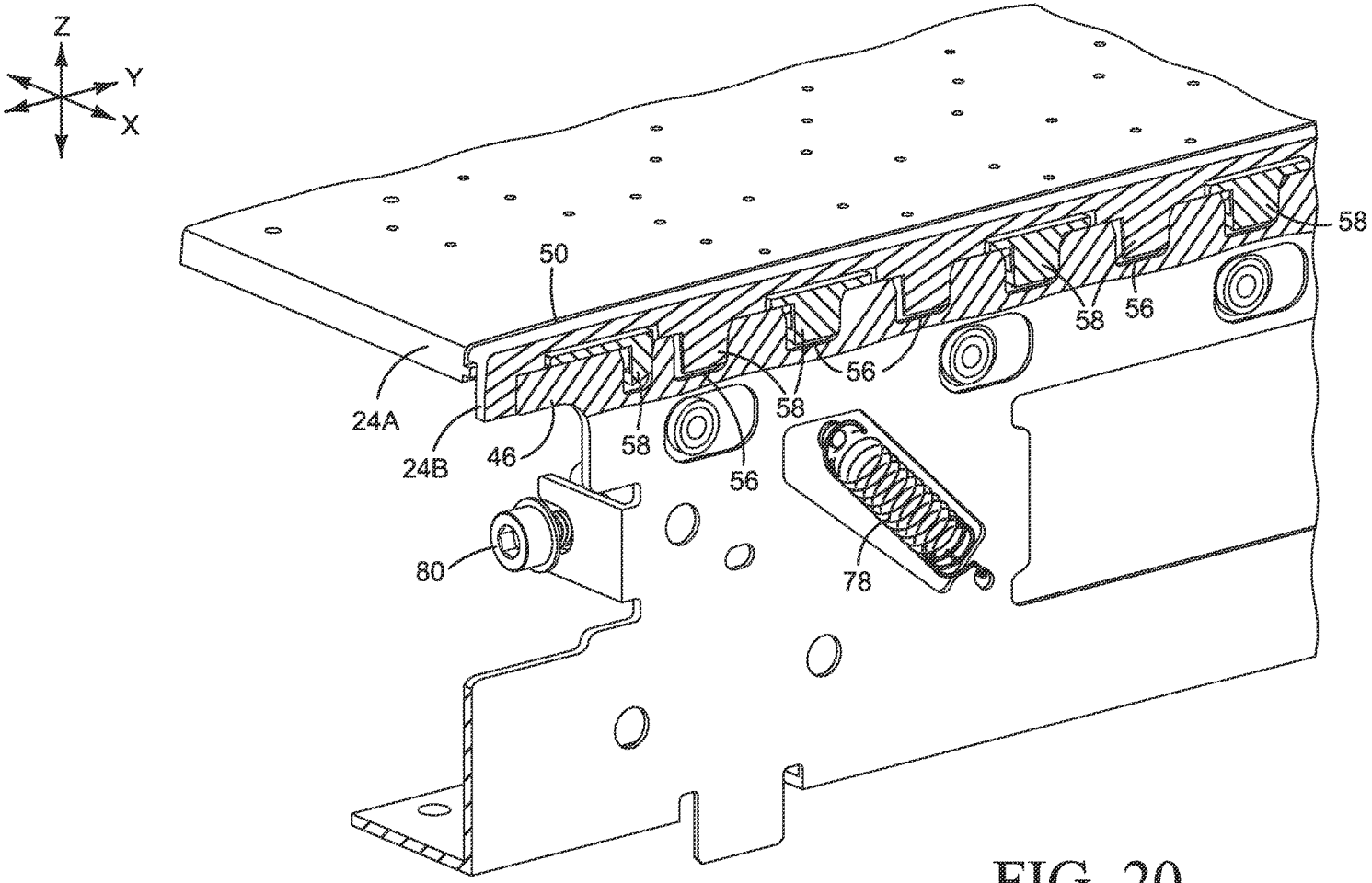

The vertical (Z direction) and horizontal (Y direction) clamping forces may be varied by varying the angle of one or both ramps 92, 94 and by varying the angle and stiffness of springs 78. FIGS. 19 and 20 show clamp 48 completely closed with tabs 58 on each platen 24A, 24B abutting the sides of corresponding chassis recesses 56.

As best seen in the exploded view of FIG. 8, the two slide plates 60, 62 are connected, and move together, through bolts 66 and nuts 64. Therefore, only one actuator is needed to move both slide plates, and the slide plates move together. Other suitable configurations are possible. For example, in some implementations it may be desirable to move the slide plates independently with separate actuators. Also, while two springs 78 are shown, more or fewer springs may be used.

Figure 21:
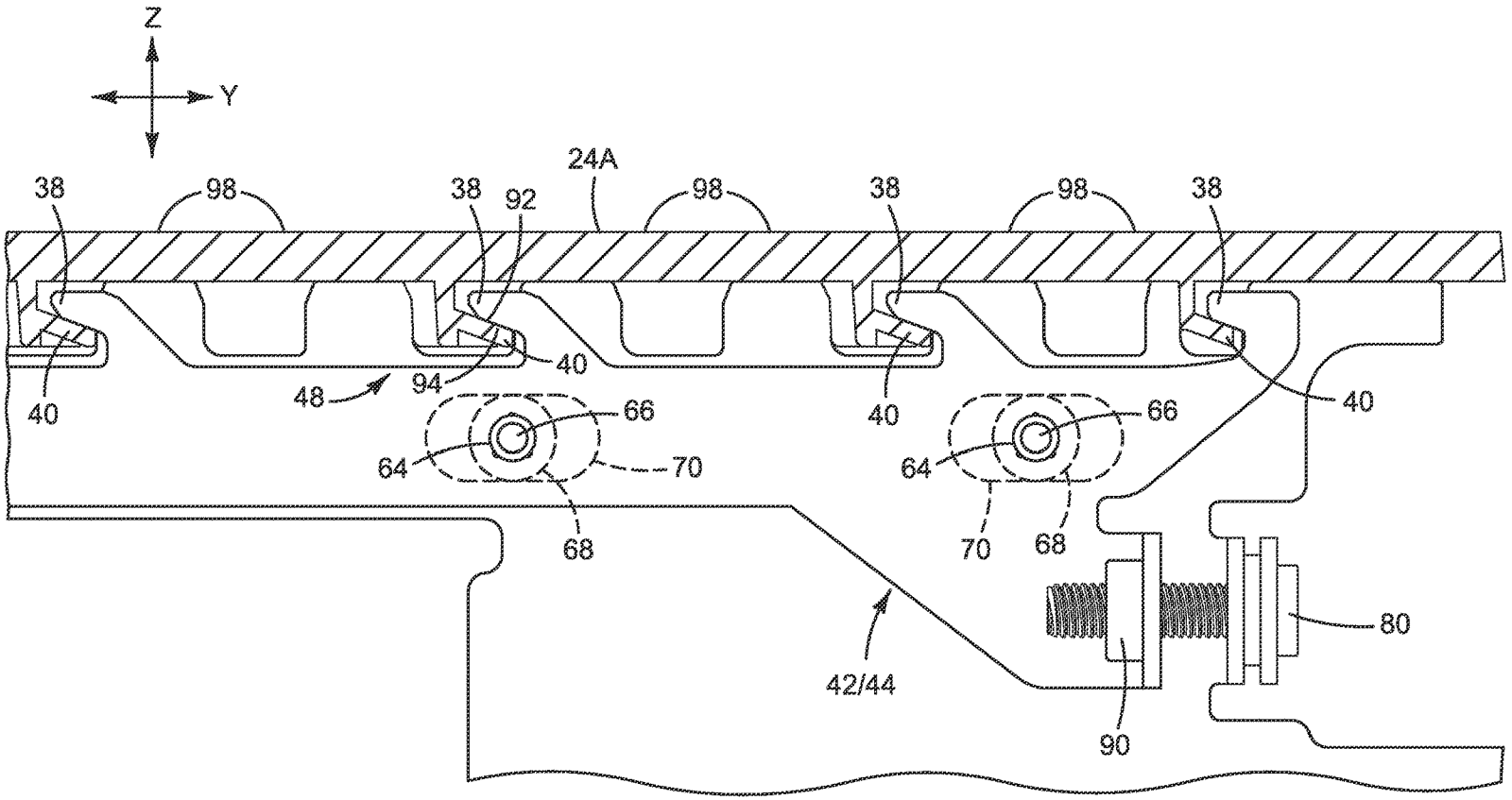
FIGS. 21 and 22-23 show other examples of a clamp to claim platens to the chassis.

In another example, shown in FIG. 21, there are no springs, and slots 70 are only slotted in the Y direction so that chassis hooks 38 cannot move in the Z direction. In this example, screw 80 is a true lead screw that drives slide plates 60, 62 back and forth in the Y direction to open and close clamp 48. Each platen is molded plastic or another suitably resilient material that will flex when subjected to a sufficient normal force. Accordingly, as ramp 92 on each chassis hook 38 is driven against a corresponding ramp 94 on the platen (platen 24B in FIG. 21), the span 98 of platen between datum surfaces 82 flexes slightly to generate a continuous clamping force to hold the platen in the desired position on chassis base 46. The flexing spans of platen in this example function like the stretched springs in the first example. The magnitude of the normal force may be varied by tightening or loosening lead screw 80 to vary the extent of engagement between ramps 92 and 94.

Figure 22:
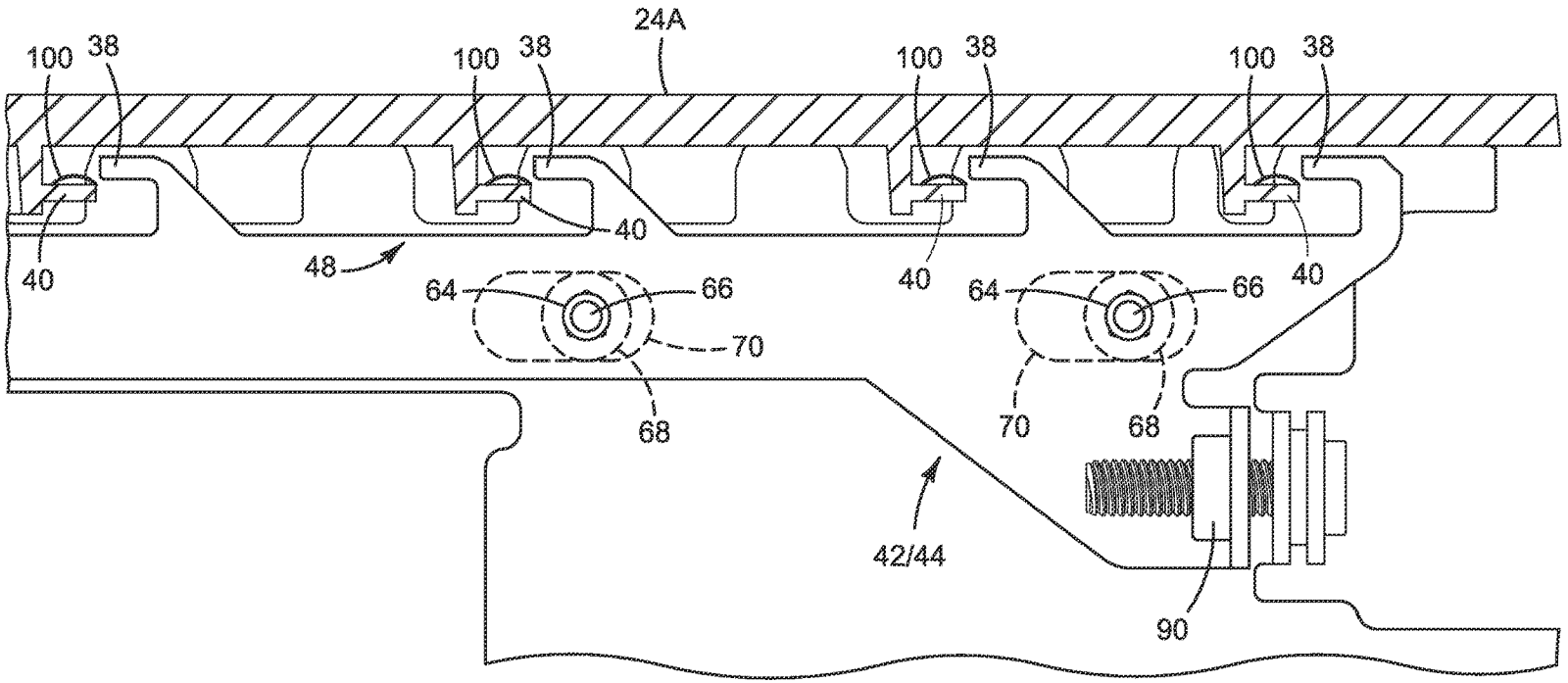
Figure 23:
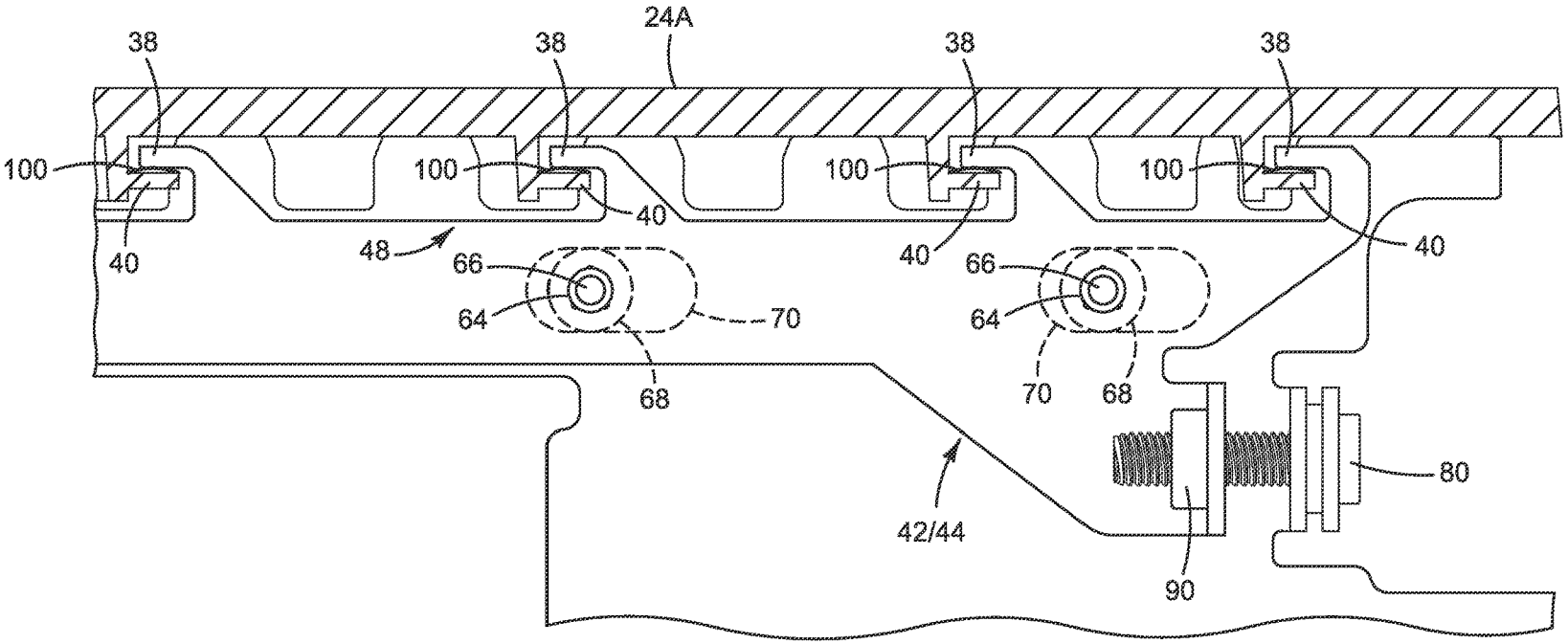

In another example, shown in FIGS. 22 and 23, a spring 100 is compressed to generate a continuous clamping force to hold the platen in the desired position on chassis base 46. FIG. 22 shows clamp 48 in an open position and FIG. 23 shows clamp 48 in the closed position. Referring to FIGS. 22 and 23, slots 70 are only slotted in the Y direction so that chassis hooks 38 cannot move in the Z direction. Screw 80 is a true lead screw that drives slide plates 60, 62 back and forth in the Y direction to open and close clamp 48. The contact faces of hooks 38 and 40 are not ramped. Rather, each platen hook 40 is fitted with a spring 100. Accordingly, as each chassis hook 38 is driven over a corresponding platen hook 40, as shown in FIG. 23, springs 100 are compressed to push the platen down on to the chassis datum surfaces with a continuous clamping force.

Figure 24:
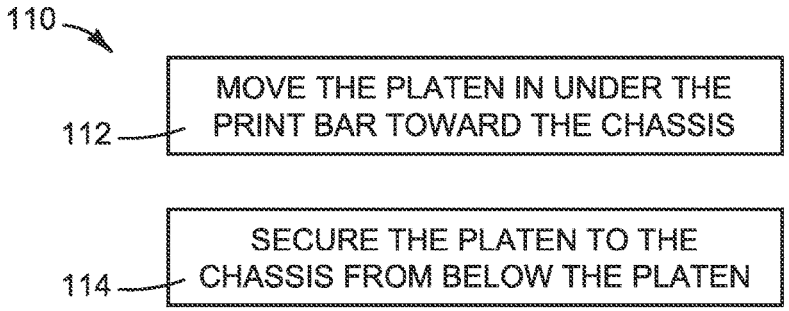
FIG. 24 is a flow chart illustrating one example of a method for installing a printer platen.

FIG. 24 is a flow chart illustrating one example of a method 100 for installing a printer platen, such as might be used to install platen 24 in printer 10 shown in FIG. 1. Referring to FIG. 24, the platen is moved in under the print bar toward the chassis (block 112) and then secured to the chassis from below the platen (block 114), for example using one of the clamps 48 shown in FIGS. 8-20, 21 and 22. In one example, the platen is secured by continuously and resiliently forcing the platen against datum surfaces on the chassis. In one example, the platen is forced against the datum surfaces by one or more of stretching a spring, compressing a spring, or flexing the platen.

Figure 25:
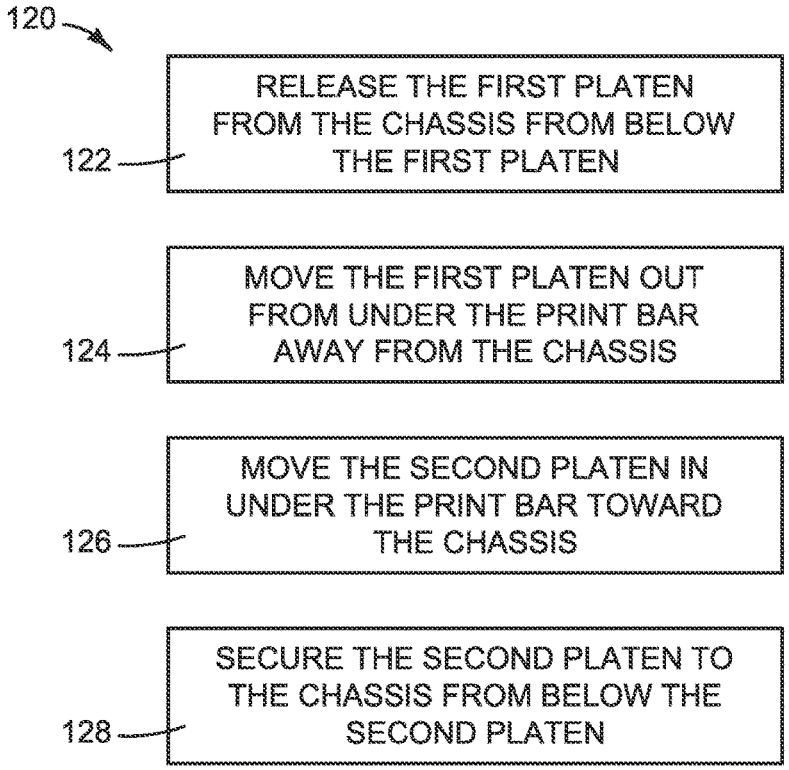
FIG. 25 is a flow chart illustrating one example of a method for replacing a printer platen.

FIG. 25 is a flow chart illustrating one example of method 120 for replacing a printer platen, such as might be used to replace platen 24 in printer 10 shown in FIG. 1. Referring to FIG. 25, the first platen is released from the chassis from below the first platen (122) and then moved out from under the print bar away from the chassis (block 124). The second platen is moved in under the print bar toward the chassis (block 126) and secured to the chassis from below the second platen (block 128).

In some examples, parts of a platen assembly for an inkjet printer have been described with reference to X, Y and Z axes in a three dimensional Cartesian coordinate system, where the X axis extends in a direction laterally across the print zone perpendicular to the direction the print substrate moves through the print zone, the Y axis extends in the same direction the print substrate moves through the print zone, and the Z axis is perpendicular to the X and Y axes which usually corresponds to the direction printing fluid is dispensed from the printheads on to the print substrate. In the examples shown, the X and Y axes extend horizontally and the Z axis extends vertically. This is just one example orientation for the X, Y, and Z axes. While this orientation for the X, Y, and Z axes may be common for many inkjet printing applications, other orientations for the X, Y, and Z axes are possible.

As noted at the beginning of this Description, the examples shown in the figures and described above illustrate but do not limit the claimed subject matter. Other examples are possible. Therefore, the foregoing description should not be construed to limit the scope of the following claims.

What is claimed is:

1. A platen holder, comprising:

a surface to support a platen, the surface including multiple datum surfaces to position the platen in a vertical direction;

a clamp to clamp the platen to the surface, the clamp having a jaw and an actuator to open and close the jaw, the jaw and the actuator both located completely below a horizontal plane on the datum surfaces and the jaw slidable at the urging of the actuator horizontally below the plane between an open position in which the platen may be placed on or removed from the surface and a closed position to hold the platen against the surface.

2. A platen holder, comprising:

a surface to support a platen, the surface including multiple datum surfaces to position the platen in a vertical direction and the plane is a horizontal plane on the datum surfaces;

a clamp to clamp the platen to the surface, the clamp having a jaw and an actuator to open and close the jaw, the jaw and the actuator both located below the horizontal plane and the jaw slidable at the urging of the actuator horizontally below the horizontal plane between an open position in which the platen may be placed on or removed from the surface and a closed position to hold the platen against the surface, and the jaw including multiple hooks slidable together to engage the platen when the jaw is in the closed position.

3. The holder of claim 2, where:

the datum surfaces are part of a stationary base; and the actuator includes a lead screw operatively connected between the base and the hooks to slide the hooks along the base to an open position.

4. The holder of claim 3, where the actuator includes a spring operatively connected between the base and the hooks to continuously urge the hooks toward the closed position.

5. The holder of claim 4, where each hook includes a ramp to exert a clamping force on the platen simultaneously down against the datum surfaces and along the base when the hooks are in the closed position.

6. A platen assembly for supporting a substrate, comprising:

a platen having first platen hooks and second platen hooks spaced apart from the first platen hooks, the first platen hooks and the second platen hooks facing a first direction;

a chassis having first chassis hooks aligned with the first platen hooks and second chassis hooks spaced apart from the first chassis hooks and aligned with the second platen hooks, the first chassis hooks and the second chassis hooks facing a second direction opposite the first direction;

the first chassis hooks movable together in the second direction between a disengaged position in which the first platen hooks and the first chassis hooks are not engaged and an engaged position in which the first platen hooks and the first chassis hooks are engaged to clamp a first part of the platen to a first part of the chassis; and the second chassis hooks movable together in the second direction between a disengaged position in which the second platen hooks and the second chassis hooks are not engaged and an engaged position in which the second platen hooks and the second chassis hooks are engaged to clamp a second part of the platen to a second part of the chassis.

7. The platen assembly of claim 6, where:

the first chassis hooks and the first platen hooks are arranged along a first line; and the second chassis hooks and the second platen hooks are arranged along a second line parallel to the first line.

8. A platen assembly for supporting a substrate, comprising:

a platen having platen hooks facing a first direction; and a chassis having chassis hooks facing a second direction opposite the first direction, the chassis hooks movable together in the second direction between a disengaged position in which the platen hooks and the chassis hooks are not engaged and an engaged position in which the platen hooks and the chassis hooks are engaged together to clamp the platen to the chassis, and where:

each platen hook includes a ramp;

each chassis hook includes a ramp; and the ramp on each chassis hook engages the ramp on a corresponding platen hook when the chassis hooks are in the engaged position to exert a clamping force on the platen down against and along the chassis.

9. The platen assembly of claim 8, comprising a spring to continuously force the ramps together when the hooks are in the engaged position.

10. The platen assembly of claim 9, where the spring includes one or more of a stretched spring, a compressed spring, or a flexed part of the platen.

* * * * *